US005646479A

United States Patent [19]

Troxell

[11] Patent Number: 5,646,479

[45] Date of Patent: Jul. 8, 1997

[54] EMISSIVE DISPLAY INCLUDING FIELD EMITTERS ON A TRANSPARENT SUBSTRATE

[75] Inventor: John Richard Troxell, Sterling Heights, Mich.

[73] Assignee: General Motors Corporation, Detroit, Mich.

[21] Appl. No.: 546,211

[22] Filed: Oct. 20, 1995

[51] Int. Cl.[6] ..... H01J 1/30

[52] U.S. Cl. ..... 313/495; 313/309; 313/336; 313/351

[58] Field of Search ..... 313/495, 309, 313/310, 336, 351

[56] References Cited

U.S. PATENT DOCUMENTS

| | | | |
|---|---|---|---|
| 4,540,983 | 9/1985 | Morimoto et al. | 340/772 |
| 5,151,632 | 9/1992 | Troxell | 315/169.1 |
| 5,209,687 | 5/1993 | Konishi | 445/6 |
| 5,210,462 | 5/1993 | Konishi | 313/495 |
| 5,210,472 | 5/1993 | Casper et al. | 313/349 |
| 5,216,324 | 6/1993 | Curtin | 313/309 |
| 5,235,244 | 8/1993 | Spindt | 313/495 |
| 5,256,936 | 10/1993 | Itoh et al. | 313/495 |
| 5,347,292 | 9/1994 | Ge et al. | 345/74 |
| 5,489,817 | 2/1996 | Muller et al. | 313/495 |
| 5,534,344 | 7/1996 | Leroux et al. | 313/309 |
| 5,557,159 | 9/1996 | Taylor et al. | 313/336 |

FOREIGN PATENT DOCUMENTS

| | | |
|---|---|---|
| 0518612A1 | 12/1992 | European Pat. Off. . |
| 0580244A1 | 1/1994 | European Pat. Off. . |
| 0582716A1 | 2/1994 | European Pat. Off. . |
| 4-87233 | 3/1992 | Japan . |
| 5-121013 | 5/1993 | Japan . |
| 6-96744 | 4/1994 | Japan . |

OTHER PUBLICATIONS

New Methods For Measuring Mechanical Properties Of Thin Films In Micromachining; Quanbo Zou Zhijian Li & Litian Liu; Institute of Microelectronics; Tsingua Univ., Bejing, China pp. 137–143; Dec. 19, 1994.

Physical properties of thin-film field emission cathodes with molybdenum cones, C. A. Spindt, I. Brodie, L. Humphrey, E. R. Westerberg; Journal of Applied Physics, vol. 47, #12 Dec., 1976.

Field-Emitter Arrays for Vacuum Microelectronics, C. A. Spindt, C. E. Holland, A. Rosengreen IEEE Transactions on Electron Devices; vol. 36, #10, Oct. 1991.

*A Survey of the Present Status of Vacuum Microelectronics*, Solid State Electronics, S. Iannazzo, vol. 36, No. 3, pp. 301–320, 1993.

*Primary Examiner*—Sandra L. O'Shea
*Assistant Examiner*—Vip Patel
*Attorney, Agent, or Firm*—Anthony Luke Simon

[57] ABSTRACT

An emissive display comprising: a first substrate including a plurality of controllable anodes; a layer of phosphor on each of the controllable anodes, wherein each phosphor emits light when the anode on which the phosphor is located is activated and electrons bombard the phosphor; a second substrate comprising a light transmissive lens having a display area through which a display is viewed, first and second electrically conductive layers and an insulating layer, wherein the first and second electrically conductive layers and the insulating layer are light transmissive, wherein the insulating layer is between the first and second electrically conductive layers and wherein the first and second electrically conductive layers and the insulating layer are on a side of the lens facing the controllable anodes and phosphor layers, wherein the second electrically conductive layer is located closer to the first substrate than the first electrically conductive layer and comprises a first plurality of holes corresponding to a second plurality of holes in the insulating layer; a plurality of opaque field emitter cones mounted to the first electrically conductive layer in the first and second plurality of holes, emitting electrons to selectively bombard the phosphors layers, wherein the plurality of opaque field emitter cones covers less than ten percent of the display area of the second substrate, wherein the emitted electrons travel through a space between the second electrically conductive layer and the phosphor layer, wherein light emitted from the phosphor layer travels back through said space and through the second substrate to be viewed by a viewer of the display.

12 Claims, 2 Drawing Sheets

EMISSIVE DISPLAY INCLUDING FIELD EMITTERS ON A TRANSPARENT SUBSTRATE

BACKGROUND OF THE INVENTION

Many known vacuum fluorescent displays use a filament and grid combination to source electrons for the vacuum fluorescent display. To improve the efficiency and brightness of displays, it is desirable to move the electron source closer to the phosphors that are the light source. However, because the filaments and grids are typically suspended, mechanical shock to the display can give rise to vibrations in the grid and the filament. This potential for vibrations limits the practical minimum distance between the electron source comprising the filament and grid and the phosphors because it is undesirable to allow the filament and/or grid to short circuit to the substrate carrying the phosphors.

A known type of display that eliminates the filament and grid includes an array of field emitters as the electron source. The field emitter array is fabricated directly to a substrate, such as silicon, and therefore does not have the suspension and vibration characteristics of the filament and grid electron sources. In known vacuum fluorescent displays using field emitter arrays, electrons travel from the field emitters across a short distance to phosphors mounted on transparent anodes, which are mounted on a transparent substrate. For reconfigurable displays, the substrates may include transparent thin film transistors to control the voltage levels of the anodes. The electrons impinging on the phosphors excite the phosphors so that the phosphors emit light. The emitted light travels through the transparent conductor, transparent thin film devices, if any, and the transparent substrate on which the phosphors and thin film devices are mounted to be viewed by a viewer of the display.

Descriptions of field emitters and their construction are included in the articles, C. A. Spindt, I. Brodie, L. Humphrey and E. R. Westerberg, "Physical properties of thin-film field emission cathodes with molybdenum cones," *Journal of Applied Physics*, Vol. 47 , No. 12, December 1996, Pages 5248–5263, and C. A. Spindt, C. E. Holland, A. Rosengreen, I. Brodie, "Field-Emitter Arrays for Vacuum Microelectronics," *IEEE, Transactions on Electronic Devices*, Vol. 38, No. 10, October 1991, Pages 2355–2363. The disclosures of the above two articles are incorporated herein by reference.

These known field emitter displays are unsuitable for high brightness display applications because they have a limited brightness achievable for a given amount of power supplied to the display. As much as 40% of the light emitted by the phosphors is reabsorbed into the phosphor and substrate before it reaches the eye of the viewer of the display. Thus for high brightness display applications, the art has been typically limited to filament and grid vacuum fluorescent displays.

Use of filament and grid vacuum fluorescent displays places limitations on the size and structure of the display. Typically, a display with a filament and a grid requires the grid to be approximately one millimeter from the emissive phosphors. This has a variety of impacts on display performance, one is display efficiency, which is reduced because the electrons must travel over a fairly large distance, i.e., over 1 mm, to reach the phosphors.

A second impact is that the spacing of display elements is limited, which has an extremely noticeable impact on reconfigurable vacuum fluorescent displays. For example, when pixels are spaced as close as 500 μm, the operation of one pixel may have an undesirable coupling effect on the operation of a neighboring pixel. Pending U.S. patent application, Ser. No. 08/205,462, assigned to the assignee of this invention, recognizes this coupling effect and sets forth a structure including an isolation grid on the substrate surrounding each pixel that eliminates the coupling effect and also the necessity for a suspended acceleration grid. This structure allows movement of the pixels closer together without any resulting undesirable coupling between the pixels. For example, displays using the isolation grid have achieved a pixel pitch of about 370 μm while retaining a 50% fill factor, where the fill factor is defined as the ratio of the phosphor covered area of the pixel (the light emitting area) to the total pixel area. Further reducing the pixel pitch while maintaining the fill factor is a challenge, though, because the isolation grid limits the spacing between neighboring pixels to no less than about 100 μm and more typically in the range of 120–150 μm. This thus limits the pixel density of the reconfigurable display.

One prior field emitter display proposal places the field emitters on the same substrate with the phosphors. This configuration eliminates the necessity to mount the phosphors on a transparent substrate but the pixel fill factor is seriously reduced due to the space required for the large multiplicity of field emission structures fabricated on the common substrate with the phosphor. Thus such displays will have inadequate brightness, fill factor and/or pixel density for many applications.

SUMMARY OF THE INVENTION

It is an object of this invention to provide an apparatus in accordance with claim 1.

Advantageously this invention overcomes prior existing limitations in the size, structure, brightness and efficiency of vacuum fluorescent displays and especially of reconfigurable vacuum fluorescent displays.

Advantageously, this invention makes use of a field emitter array for a vacuum fluorescent display with a new structure.

Advantageously, this invention provides a field emitter array for use in a vacuum fluorescent display that eliminates the necessity of a transparent substrate from carrying the emissive phosphors. This invention advantageously allows the use of a silicon wafer or other opaque thermally conductive substrate for carrying the excitable phosphors of a vacuum fluorescent display and allows implementation of addressing transistors on to the thermally conductive substrate, eliminating the necessity of transparent thin film transistors in a display with a field emitter array.

Advantageously, this invention provides a vacuum fluorescent display with a field emitter array allowing close proximity between the field emitter array and the light emissive phosphors, increased brightness, increased efficiency and lower field voltages of the display. This invention allows the field emitter array to be placed in a range of 100 μm from the emitting phosphor surface of the pixel of a vacuum fluorescent display viewed by a viewer of the display, this compares to the spacing between the filament and the pixel of 500 μm to 2 mm in the above mentioned patent application Ser. No. 08/205462 and in known prior art, and compares to the placing of the field emitter structure closest to the surface of the phosphor furthest from the viewer of the display in known prior art field emitter displays. Further, by achieving a field emitter structure so close to the viewing side of the display pixels, the coupling effect previously mentioned is eliminated without the necessity of an isolation grid structure on the substrate surrounding each pixel. Thus, this invention enables a decrease in the spacing between neighboring pixels in a display and a corresponding increase in pixel density. The distance between neighboring pixels is reduced from a minimum of about 100 μm to distances in the range of 50 μm and possibly even less. The result is a decrease in pixel pitch to 170 μm or less and an increase in pixel density of five times that previously available for front lit vacuum fluorescent displays. Additionally, the increase in pixel density allows a 50 to 80% reduction in the size of the display when used as an image source to be projected or for other small size applications, providing a corresponding significant cost savings.

Further advantages arising out of this structure include the use of a silicon wafer to provide addressing electronics such as CMOS transistors, providing performance advantages and improved heat dissipation over thin film transistors fabricated on transparent substrates. Alternatively, the silicon wafer may serve as a substrate for thin film transistors, offering improved display brightness because of the improved heat transfer of the silicon as compared to that of known transparent substrates.

In a preferred example, this invention provides an emissive display comprising: a first substrate including a plurality of controllable anodes; a layer of phosphor on each of the controllable anodes, wherein each phosphor emits light when the anode on which the phosphor is located is activated and electrons bombard the phosphor; a second substrate comprising a light transmissive lens having a display area through which a display is viewed, first and second electrically conductive layers and an insulating layer, wherein the first and second electrically conductive layers and the insulating layer are light transmissive, wherein the insulating layer is between the first and second electrically conductive layers and wherein the first and second electrically conductive layers and the insulating layer are on a side of the lens facing the controllable anodes and phosphor layers, wherein the second electrically conductive layer is located closer to the first substrate than the first electrically conductive layer and comprises a first plurality of holes corresponding to a second plurality of holes in the insulating layer; a plurality of opaque field emitter cones mounted to the first electrically conductive layer in the first and second plurality of holes, emitting electrons to selectively bombard the phosphors layers, wherein the plurality of opaque field emitter cones covers less than ten percent of the display area of the second substrate, wherein the emitted electrons travel through a space between the second electrically conductive layer and the phosphor layer, wherein light emitted from the phosphor layer travels back through said space and through the second substrate to be viewed by a viewer of the display.

In one example, the field emitters are placed a distance in a range of approximately 100 to 400 μm from a substrate with emissive material thereon that emits light when bombarded by electrons emitted from the field emitters. In another example the emissive material is located on each of a plurality of individually addressable pixels, wherein each pixel is within a distance of 90 μm or less of a neighboring pixel. In yet another example, the individually addressable pixels having a fill factor of 50% achieve a pixel density of 35 per square mm or a pixel pitch of 170 μm.

BRIEF DESCRIPTION OF THE DRAWINGS

The present invention will now be described by way of example with reference to the accompanying drawings in which.

DETAILED DESCRIPTION OF THE INVENTION

Figure 1:
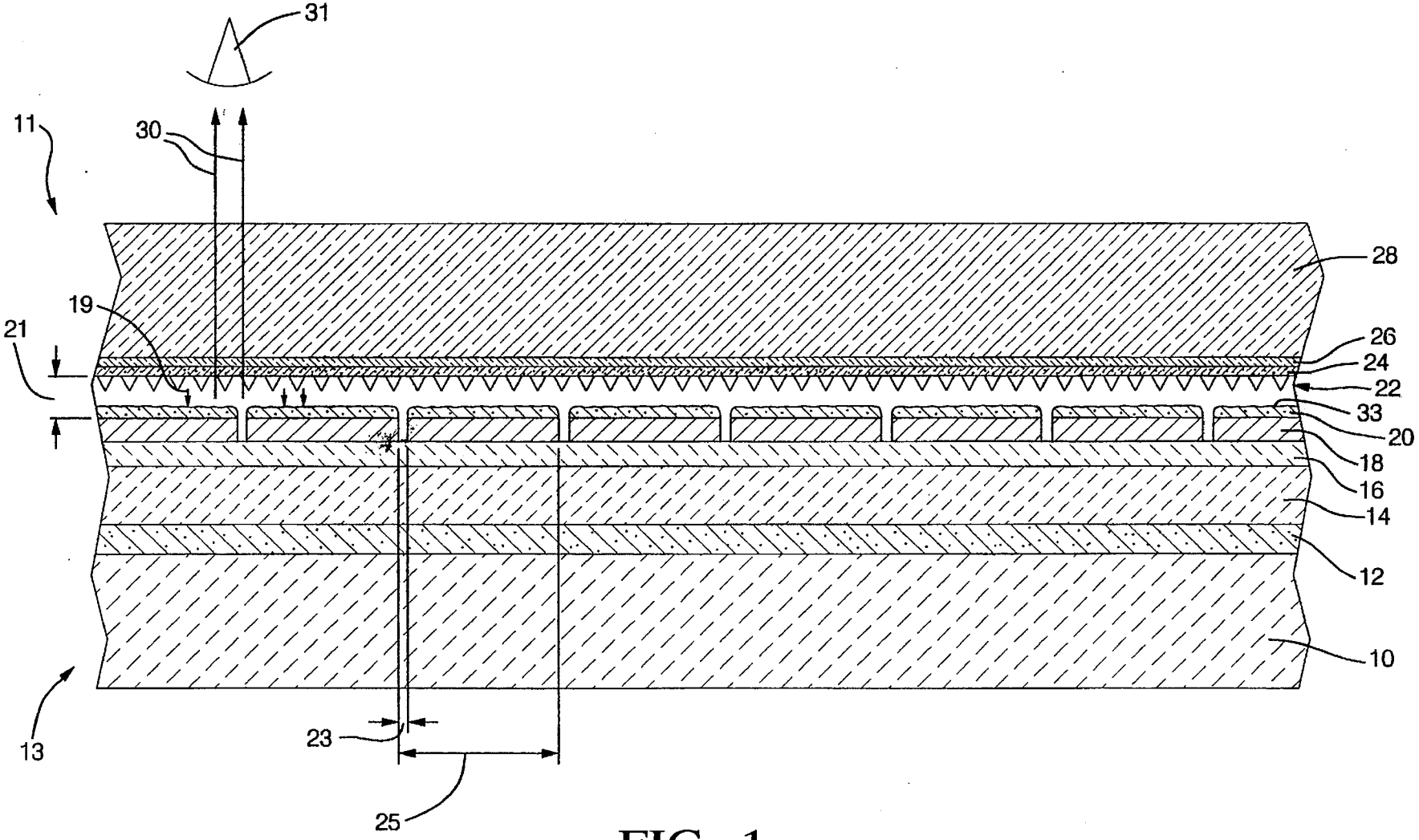
FIG. 1 illustrates a schematic diagram of an example emissive display according to this invention.
Figure 2:
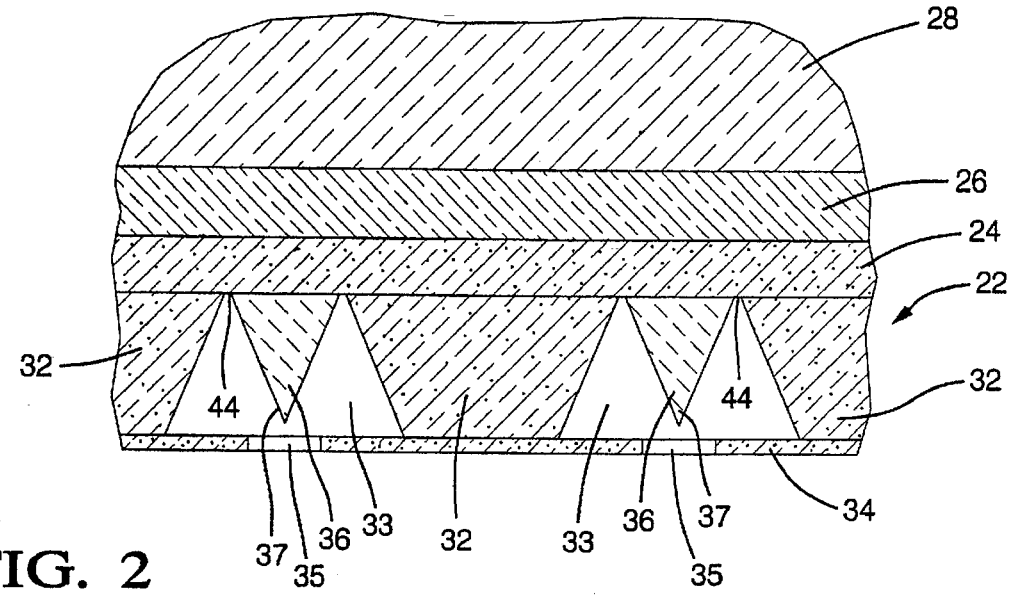
FIG. 2 illustrates the structure of a field emission electron source according to this invention.
Figure 3:
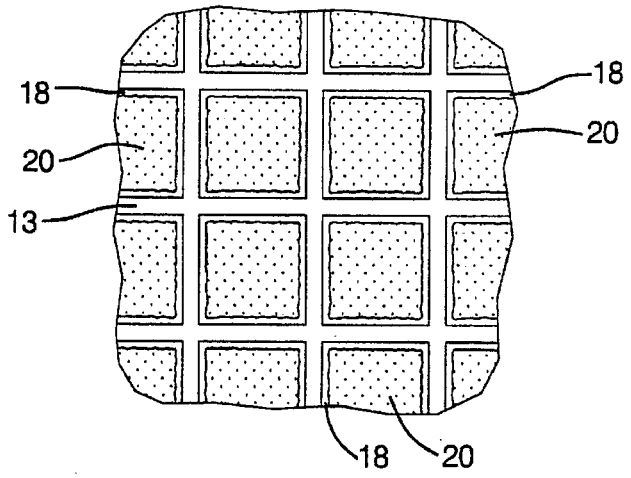
FIGS. 3 illustrates a view of substrate 13 of the display 11 according to this invention.

Referring to FIGS. 1–3, an emissive display according to this invention is shown as display 11 including a cover lens 28 and base 13. Base 13 includes support 10, comprising glass on which is bonded silicon substrate 14, held in place by adhesive 12. The substrate 14 includes an array of addressing transistors (not shown) selectively biasing conductive pixel pads 18, separated from the array of addressing transistors by insulating silicon dioxide layer 16. Each conductive pixel pad 18 includes an emissive material 20, such as a phosphor of the type known to those skilled in the art of vacuum fluorescent displays, on the top surface of the conductive pad 18. The emissive material 20 is of a type that emits visible light when bombarded by electrons.

Details for fabrication of the addressing electronics and/or driver circuit for the vacuum fluorescent display are known to those skilled in the art and need not be set forth herein in more detail. In a known manner, the conductive pads 18 (anodes) are electrically coupled to the desired conductor or semi-conductor elements on the silicon wafer 14 vis-à-vis holes selectively provided in the silicon dioxide layer 16 and deposited with metal.

The cover lens 28 includes an optically transparent insulating layer 26, transparent conductor 24 and field emitter array 22. According to this invention, all components of the field emitter array 22 are optically transparent except for the cone shaped emitter structures 36 themselves (described below with reference to FIG. 2). However, the cone-shaped emitter structures 36 cover approximately 4 percent or less of the light transmissive area of the array and thus do not impede viewing of the display through the lens 28.

Referring now also to FIG. 2, the structure of the field emitter array 22 according to this invention and its fabrication are now described in more detail. The lens 28 acts as a transparent second substrate base and comprises, for example, glass or fused quartz. The lens 28 is cleaned and an optically transparent insulating layer 26 such as silicon dioxide is deposited thereon to a thickness of approximately 1.0 μm. The use of silicon dioxide insulating layer 26 is discretionary but preferred because (a) it provides a well defined substrate upon which the transparent conductor 24 can be deposited, (b) it suppresses the out diffusion of ionic contaminants such as sodium from the glass substrate lens 28, which contaminants could adversely affect phosphor and/or field emitter performance; and (c) it improves the adhesion of the transparent conductive layer 24 to the substrate lens 28.

After the silicon dioxide layer 26 is deposited, a transparent conductor, for example, indium tin oxide, is then deposited to form layer 24 having a thickness of approximately 400 μm. While 400 nm is a preferred thickness given for this example, the thickness of the conducting layer 24 and the other conducting layer 34 discussed below may be varied from implementation to implementation. However, the thickness of each conducting layer is restricted in part by the transparency of the film (as in the case when titanium nitride is used in place of indium tin oxide) and the resistivity of the resulting deposited layer. It is desirable to choose a resistivity of the transparent conducting layer 26 that is low enough to support an adequate emission current from each field emitter. However, it is also desirable to insure that a current significantly in excess of the adequate emission current cannot be supplied to a given emitter. This insures that in case of failure of a given emitter, the remaining emitters serving a given pixel are not also deactivated. That is, the resistivity of the transparent conducting films is selected such that a short circuit between the conducting layers 24 and 34 at a particular emitter is isolated in terms of its influence on adjacent emitters. This approach, which essentially amounts to placing resistors in series with each emitter structure, has been employed in the case of non-transparent conductors, as described in the above-mentioned Spindt et al. article, "Field-Emitter Arrays for Vacuum Microelectronics."

The film 24 may be photolithographically patterned into strips to define the width of the ultimate pixels. Patterning of the conductor layer 24 can be done by wet chemical means, by a plasma assist process, by reactive ion etching using silicon tetrachloride or by ion milling as is known to those skilled in the art.

After the first transparent conductive layer 24 is deposited and patterned, a second insulator layer 32, preferably silicon dioxide and thicker than the original layer 26, is deposited on the first transparent conductor layer 24. The thickness of the second insulating layer 32 is set by the desired height of the field emission sources which typically range from 0.5–2.0 μm. After the transparent silicon dioxide layer 32 is deposited, a second transparent conducting layer 34, for example indium tin oxide, is then deposited, typically to a thickness of approximately 200 nm. The transparent conducting layer 34 in the completed display serves as the extraction grid for the field emitters. Once the second transparent conducting layer 34 is applied, a photolithographic process is used to define the locations of the field emitters by patterning the transparent conductive layer 34 using, for example, reactive ion etching and a silicon tetrachloride etching gas in combination with a photoresist masking layer.

After the transparent conductor film is patterned, the photoresist masking layer used in the patterning is removed. The patterned transparent conductive layer 34 is then itself employed as a masking layer to define the etching of the underlying silicon dioxide layer 32 using, for example, buffered hydrofluoric acid. At this point, the substrate includes the two transparent conductor layers 24 and 34 separated by the silicon dioxide layer 32 with an array of holes 33, 35 that penetrate both the transparent conductor layer 34 and the silicon dioxide layer 32, exposing portions 44 of the transparent conductive layer 24.

The field emitter structures themselves are then fabricated into the exposed portions 44 of the transparent conducting layer 24. A typical material used for the emitter structures is molybdenum, which is an opaque material, and the resultant structures are cone shaped, as illustrated by structures 36 in FIG. 2. The fabrication process for the field emitter structures 36 is performed in a manner known to those skilled in the art and an example of a typical desirable fabrication process for field emitter structures 36 is described by Spindt et al. in the above-mentioned article, "Physical properties of thin-film field emission cathodes with molybdenum cones." Because such fabrication processes are well known to those skilled in the art and well described in the literature, the details of the fabrication of the emitter structures 36 need not be set forth herein.

When the second substrate, including the electron source comprising the field emitter array 22, is assembled to the remainder of the display including the first substrate comprising glass base substrate 10 and the phosphor 20, and when the space between the substrates is vacated of air, the display structure is complete and can be operated as described herein.

In general, electrons are emitted from the field emitters 36 without requiring the application of heat. The conductive layer 24 is biased to a negative voltage reference or ground thereby providing the negative voltage reference or ground reference to emitters 36. The conductive layer 34 is biased to a higher voltage reference, for example, 10–100 volts higher than the voltage reference applied to the field emitters 36, creating an emission field around the tips 37 of the emitters 36. During display operation, the voltage references can be applied to the conductive layers 26 and 24 around the entire array of field emitters 36 and need not be selectively switched on and off. This causes electrons to emit from the emitters 36.

The display 11 is caused to emit light in the desired display patterns by selectively activating the anodes 18 to high voltage references. When a particular anode is so activated, it creates an acceleration field between the anode 18 and the nearby emitters 36, causing electrons 19 freed due to the emission field around the emitters 36 to drive toward the anode 18, striking the phosphors 20 in the path and causing emission of light from the phosphors 20. The circuitry and control required to selectively activate the particular anodes 18 is well known to those skilled in the art of reconfigurable vacuum fluorescent displays and need not be set forth herein.

In contrast to prior art field emitter displays, the light emitted by phosphors 20 does not need to travel through substrate 13 to be viewed. Such a path of light travel significantly reduces the magnitude of luminance created by the display due in part because the most light emitter from the phosphors is on the side of the phosphors furthest from the viewer of the display and increasing current to the display to overcome this handicap is both inefficient and may cause damage to the display, including premature degradation of the phosphors. By forcing the light to be viewed from the side of the phosphors furthest from that first struck by the electrons, 40% of the light emitted is reabsorbed by the phosphors and substrate before it reaches the eye. Further, substrate and circuitry carrying the phosphors must be transparent and therefore has a limited ability to include heat-dissipating structures, limiting the current capacity of the prior art display.

According to this invention, the emitted light is viewed (by an observer's eye 31) through lens 28, thus providing a direct path for the brightest emitted light from the surface 33 of the phosphors 20 through the transparent layers 24, 26, 32 and 43 and through transparent lens 28. The only optical restrictions to the light transmission are the emitter cones, which are opaque. But as will now be explained, this restriction has minimum impact. The result is an increase in display brightness according to this invention of over 60% as compared to field emitter displays according to the prior art using the same amount of power.

Typically, each field emitter generates 0.1 mA of emission current. A vacuum fluorescent display that typically requires an electron current density of 20 mA/cm$^2$ and comprises a series of addressable pixels, each having an area of $1.2\times10^{-3}$ cm$^2$, requires on the order of 24 μA for each pixel. Such a display requires 240 field emitters at each pixel, which is easily achieved. For example, assuming each emitter base has a diameter of 5 μm, then 240 emitters requires a total area of approximately $5\times10^{-5}$ cm$^2$, which is approximately only 4 percent of the total pixel area. Because the molybdenum emitters are opaque and the remainder of the structure of the substrate is transparent, the opaque emitters block out only 4 percent of the total light transmitting area corresponding to the pixel, resulting in minimal interference with the emission of light from the display.

In another example, assume it is desirable to increase electron current density available to each pixel so that the field emitters are packed as closely as possible in the proximity of each pixel. Using field emitters having a height of 1.5–2.0 μm and base diameters of approximately 1.0 μm, this allows a spacing between the emitters of approximately 10 μm. For the above-described display with a pixel area of $1.2\times10^{-3}$ cm$^2$, pixel dimensions are approximately 350 μm on the sides. This allows an array of 35×35 field emitters for each pixel for a total of 1225 emitters for each pixel. Summing up the total area covered by the field emitters, which is the total opaque area, results in only $9.6\times10^{-6}$ cm$^2$ of opaque area yielding less than a 1 percent opaque coverage of the total pixel area. Again, the opaque emitters have a negligible adverse affect on display luminance.

For the first time, then, this invention provides a vacuum fluorescent display using field emitters that allow viewing of the display through the field emitter array. By achieving this advantageous structure, this invention increases the light emitting efficiency of front-viewed displays and for the first time allows a vacuum fluorescent display using field emitters suitable for high brightness display implementations such as in a vehicle projected head up display.

Before further describing the structural improvements according to this invention, an example of a high brightness display for which this invention is suitable, a projected display such as a vehicle head-up display, is explained as follows. In a projected head-up display, any light traveling in the direction, other than the direction of light projection path, is wasted. Further, the vehicle windshield, when used as the combiner or projection screen for the display, typically reflects only about 10 percent of the light from the display to the vehicle driver's eye 60. Thus the display 50 must be capable of emitting light in the range of 6000 ft L. (foot Lamberts), or at least 1750 candela/m$^2$, to achieve a suitably bright display for the vehicle operator. According to this invention, a field emitter display structure is provided capable of achieving the required illumination intensity.

While it is desirable to achieve a display with increased brightness, it is also desirable to increase pixel density on the display, or, put another way, reduce the necessary spacing between neighboring display elements. As explained above, for front-viewed vacuum fluorescent displays, or displays that are viewed from the same side from which the phosphors are bombarded, there has existed until now certain restrictions on the pixels spacing and density and pixel to electron source spacing. The structure of this invention allows the spacing of the electron source to the phosphor for front-viewed displays to be reduce from approximately 500 μm (or even more typically 1.2–2 mm) to the range of 100 μm. Thus the distance 21 in FIG. 1 can be as small as in the range of 100 μm to achieve the greatest display efficiencies and, in other examples, will typically fall within the range of 100–400 μm. By allowing the electron source to be in the range of 100–400 μm from the display elements or pixels, the undesirable coupling effect addressed in the U.S. Pat. No. 5,541,478, is eliminated.

Prior to this invention, neighboring pixels in a front-viewed vacuum fluorescent display were required to be in the range of at least 100–150 μm from each other to avoid an undesirable coupling effect, and that was achieved using an isolation grid on the substrate with the pixels. According to this invention, neighboring pixels can be in the range as small as approximately 50 μm from each other and will in various examples be in the range of 50–90 μm. This distance is represented by distance 23 in FIG. 1. Further improvements may be achievable with advances in pixel fabrication techniques.

Figure 4:
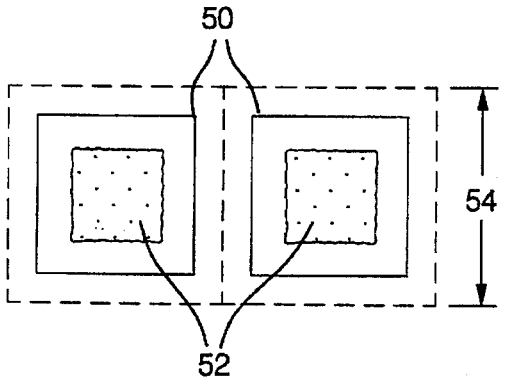
PRIOR ART FIG. 4
FIG. 4 illustrates an example pixel phosphor configuration.

Prior to this invention, to achieve a minimum practical pixel pitch of 200 μm, the maximum actual phosphor size on each pixel was only approximately 90×90 μm using known phosphor deposition techniques while achieving a display without undesirable coupling. Thus, the resulting "fill factor" or ratio of the light emissive area to the total area of the individual pixel was very small, approximately 20%. An example of this is shown in FIG. 4, where reference 50 indicates the space allocated for each of two neighboring pixels and distance 54 represents the pixel pitch. The portions 52 represent those areas filled with phosphor 20, and therefore the only area of each pixel capable of emitting light. The reconfigurable display with such pixels has a grainy luminous appearance, and the area average averaged luminance of the display is small because only 20% of each pixel area is capable of emitting light.

Figure 5:
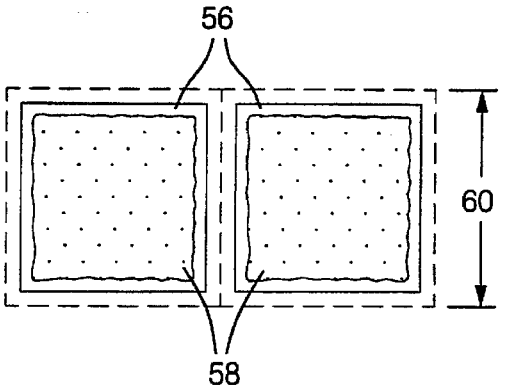
FIG. 5 illustrates an advantageous pixel phosphor configuration according to this invention.

In contrast to the prior art, according to this invention the space between phosphors can now be reduced to approximately 50 μm and may be reduced further as lithography techniques for depositing the phosphor improve. The result is that even if the pixel pitch is reduced to 150 μm, the fill factor of each pixel is still at least 44% and if the pixel pitch is kept at 200 μm, the fill factor increases to 56%, an increase of 180%. This improvement is shown in FIG. 5, where each pixel 56 has a pitch 60 equal to 200 μm, the 56% fill area of phosphor, represented by references 58, shows a substantial reduction in the amount of space between light emitting phosphors and a corresponding substantial increase in light emitting area in each pixel. This will eliminate the graininess mentioned above as appearing in the prior art.

As a practical example of the advantages according to this invention, assume a display is required to have an array of pixels with a minimum 50% fill factor and a pixel pitch as small as possible. Prior to this invention, the minimum pixel pitch capable of meeting this standard and not having undesirable pixel-to-pixel coupling was 375 μm. According to this invention, the pixel pitch can be reduced to 170 μm while still achieving the 50% fill factor, reducing the necessary pixel area by a factor of nearly five. Thus, on the same size substrate that only one display was made, now almost five displays can be made still having a 50% fill factor. This enables a cost reduction in display manufacture and the availability of reconfigurable vacuum fluorescent displays for new applications requiring very small display devices.

The sum result of all of these advantages is that this invention enables an increase in pixel density of five times over that previously available. Prior pixel densities limited to seven pixels per square millimeter are now replaced by pixel densities of 35 pixels per square millimeter when using this invention. Further improvement in pixel density will be realized with further improvements in the ability to pattern the phosphors.

While this invention enables a range of advantageous improvements in display design, in one example, the improvements can be described as including a display with an array of pixels having a pixel pitch of less than 350 μm while each pixel has a fill factor of at least 50%.

Materials suitable for the transparent conductor material may include indium tin oxide, as described above, titanium nitride or other transparent electrically conducting materials known to those skilled in the art, with the requirements that the materials are able to survive the process used to fabricate the emitter structures 36, cannot adversely affect performance of the resulting display, for example, do not out-gas under the operating conditions and can be precisely patterned using lithographic processes familiar to those skilled in the art.

This invention, as described above, is ideal for use in high brightness reconfigurable vacuum fluorescent displays. By allowing light to transmit through the field emitter array, as opposed to the substrate upon which the phosphor is deposited, CMOS circuits can be fabricated in a silicon wafer applied as part of the substrate carrying the phosphor. The CMOS circuits are more efficient and the silicon wafer is more heat conductive than typical thin film transistor layers in their base substrates, allowing for a more efficient and brighter emissive phosphor.

The advantages of the improved heat transfer available to the display using the field emitters according to this invention may be understood with reference to the following example. Assuming a high brightness vacuum fluorescent display including a conventional filament and grid structure capable of luminance intensity of 7000 ftL having a total display area of 1 $cm^2$. An example such display operates at 50 volts with pixel current densities of approximately 20 mA $cm^{-2}$, with a comparable current flow lost to the grid structure. The total power dissipated by the electron flow from the electron source to the phosphor is approximately 2 Watts, which is the amount of energy that must be dissipated through the substrate on which the phosphor elements are deposited. A display constructed on a glass substrate, having a thermal conductivity of approximately 1 W/(mK), and 0.25 cm thick, has a thermal resistivity of approximately 25 K/W. Thus for a 2 Watt load, the expected temperature rise of the phosphor in the display with respect to ambient temperature is 50 K.

A prior art field emission display using the same pixel current density has less power lost to the phosphor substrate, in the range of 1 Watt. Assuming a glass substrate for the phosphor (remembering that in this prior art example the substrate carrying the phosphor must be transparent), the thermal resistivity is again 25 K/W and the corresponding temperature rise in the phosphor is 25 K above ambient temperature.

Assume an example display according to this invention with the same pixel power density as the prior art that must dissipate 1 Watt of power in the substrate carrying the phosphor. However, the substrate can be opaque, for example silicon, since the display is not viewed through the substrate. The thermal conductivity of silicon is in the range of 84 W/(mK), much higher than that of glass and the resulting substrate had a thermal resistivity of approximately 0.3 K/W. As a result, the temperature rise across the silicon substrate is less than 1 K. Thus, for the same power dissipation from the prior art field emission display, the phosphor temperature in the display according to this invention is approximately 24 K lower than that of the prior art. Since phosphor temperature is inversely proportional to phosphor brightness, the display according to this invention is brighter. In the example in which 1 Watt of power is dissipated per square cm, the brightness of the display according to this invention due to improved heat dissipation alone is 67% greater than the prior art field emitter display in which the phosphor must be located on the transparent substrate.

The above-described examples use molybdenum emitter cones 36 in the emitter array 22. In another example, the field emission cones can be fabricated from the same Indium Tin Oxide used to form the conductive layer 24. In this example, the display fabrication is as described above, up to the point at which the opaque molybdenum field structures are fabricated. At that point, instead of fabricating the molybdenum field emitter structures, the deposition of indium tin oxide is substituted with a short preliminary step of sputter etching the exposed portions 44 of layer 24 to assure adhesion of the indium tin oxide film field emitter material to the substrate conductive layer 24.

The advantages of U.S. Pat. No. 5,151,632, assigned to the assignee of this invention, may be used with this invention if desired.

This invention need not be limited to displays including driver electronics such as the matrix-addressable display, but may be used for emissive displays that do not need the matrix-addressing transistor mentioned above to obtain the same benefits previously described herein.

In the above examples of this invention, the term "lens" is used to describe the transparent glass or substrate through which the display is viewed and does not imply a necessity to focus light or the display.

Referring again to FIGS. 1 and 2, in another example according to this invention, the field emitter array is fabricated in a known manner in which groups of field emitters are selectively addressed in row and column fashion. One known technique for this is to pattern the conductive layer 24 as a series of row electrodes and the conductive layer 34 as a series of column electrodes or vise verse. Particular groups of field emitters are activated by selectively addressing the corresponding row and column electrodes comprising conductive layers 24 and 34.

In this example display, it is not necessary to physically or electrically define the phosphor or anode elements of the display device into pixels because the pixels are defined by the configuration of the sets of field emitters that are biased in the conventional matrix addressing fashion. Thus in this example, the phosphor layer 20 and, possibly, the conductive pads 18 are formed as one large anode (as opposed to the space separated anodes shown in FIG. 1).

Because in this example it is unnecessary to pattern the phosphor layer, the fill factor for the pixels of the display is as high as almost 100%.

The advantage of this example of the invention is a brighter display (approximately 40% brighter) than prior art displays of similar type because the phosphors are viewed through the lens 11 including the emitter array 22. Additional brightness gains are realized because the substrate on which the anode is fabricated need not be transparent, and can therefore be fabricated with improved heat dissipation.

While the above described examples refer to vacuum fluorescent displays of a type using relatively low emitter voltages, this invention may be used in displays in which high emitter voltages are used, i.e., 1000–2000 volts and higher, in which case the array of field emitters is spaced further from the display phosphors.

I claim:

1. An emissive display comprising:

a first substrate including a plurality of controllable anodes;

a layer of phosphor on each of the controllable anodes, wherein each phosphor emits light when the anode on which the phosphor is located is activated and electrons bombard the phosphor;

a second substrate comprising a light transmissive lens having a display area through which a display is viewed, first and second electrically conductive layers and an insulating layer, wherein the first and second electrically conductive layers and the insulating layer are light transmissive, wherein the insulating layer is between the first and second electrically conductive layers and wherein the first and second electrically conductive layers and the insulating layer are on a side of the lens facing the controllable anodes and phosphor layers, wherein the second electrically conductive layer is located closer to the first substrate than the first electrically conductive layer and comprises a first plurality of holes corresponding to a second plurality of holes in the insulating layer;

a plurality of opaque field emitter cones mounted to the first electrically conductive layer in the first and second plurality of holes, emitting electrons to selectively bombard the phosphors layers, wherein the plurality of opaque field emitter cones covers less than ten percent of the display area of the second substrate, wherein the emitted electrons travel through a space between the second electrically conductive layer and the phosphor layer, wherein light emitted from the phosphor layer travels back through said space and through the second substrate to be viewed by a viewer of the display.

2. An emissive display comprising:

a first substrate including a plurality of controllable anodes;

a layer of phosphor on each of the controllable anodes, wherein each phosphor emits light when the anode on which the phosphor is located is activated and electrons bombard the phosphor;

a second substrate comprising a light transmissive lens having a display area through which a display is viewed, first and second electrically conductive layers and an insulating layer, wherein the first and second electrically conductive layers and the insulating layer are light transmissive, wherein the insulating layer is between the first and second electrically conductive layers and wherein the first and second electrically conductive layers and the insulating layer are on a side of the lens facing the controllable anodes and phosphor layers, wherein the second electrically conductive layer is located closer to the first substrate than the first electrically conductive layer and comprises a first plurality of holes corresponding to a second plurality of holes in the insulating layer;

a plurality of opaque field emitter cones mounted to the first electrically conductive layer in the first and second plurality of holes, emitting electrons to selectively bombard the phosphors layers, wherein a distance between the second electrically conductive layer and the anodes is in a range less than 400 μm, wherein the emitted electrons travel through a space between the second electrically conductive layer and the phosphor layer, wherein light emitted from the phosphor layer travels back through said space and through the second substrate to be viewed by a viewer of the display.

3. An emissive display comprising a field emission electron source including a light transmissive substrate, a first light transmissive electrically conductive layer on the substrate, a light transmissive electrically insulating layer, a second light transmissive electrically conductive layer, wherein the insulating layer is fabricated onto the first conductive layer and separates the first and second conductive layers, and an array of field emitters fabricated on the first conductive layer, wherein the field emitters are opaque and cover less than ten percent of a total light transmissive area of the substrate, the first and second conductor layers and the insulating layer.

4. An emissive display comprising a first substrate including at least one anode and at least one phosphor film on the anode, a field emission electron source including a second substrate spaced apart from the first substrate, the second substrate comprising a transparent base, a first transparent electrically conductive layer, a transparent insulating layer on the first transparent electrically conductive layer, a second transparent electrically conductive layer on the transparent electrically insulating layer, and an array of field emitters on the first transparent electrically conductive layer, wherein the array of field emitters is less than 400 μm from the anode and emits electrons to the anode causing light to emit from the phosphor film, which emitted light travels through the second substrate to be viewed by a viewer of the display.

5. An emissive display according to claim 1 wherein each of the controllable anodes is less than about 90 μm from each neighboring anode.

6. An emissive display according to claim 1 wherein each of the controllable anodes is in a range of approximately 50 μm or less from each neighboring anode.

7. An emissive display according to claim 2 wherein the distance between the second electrically conductive layer and the anodes is in a range of 100 μm.

8. An emissive display comprising:

a light transmissive substrate comprising first and second electrically conductive layers and an electrically insulating layer separating the first and second electrically conductive layers, wherein the first and second electrically conductive layers and the electrically insulating layer are transparent, and an array of opaque field emitters attached to the first conductive layer;

a pixel substrate comprising an array of pixels, each pixel comprising an anode and a layer of phosphor on the anode, wherein the field emitters emit electrons that travel across a space to strike the phosphors and cause the phosphors to emit light, wherein the emitted light travels back across the space and through the light transmissive substrate to be viewed by a viewer of the display, wherein the array of pixels has a pixel pitch of less than 350 μm and each pixel has a fill factor of at least 50%.

9. An emissive display comprising:

a first substrate including at least one anode;

a layer of phosphor on the anode, wherein at least a portion of the phosphor emits light when electrons bombard the phosphor;

a second substrate comprising a light transmissive lens having a display area through which a display is viewed, first and second electrically conductive layers and an insulating layer, wherein the first and second electrically conductive layers and the insulating layer are light transmissive, wherein one of the first and second electrically conductive layers is patterned in rows and the other of the first and second electrically conductive layers is patterned in columns, wherein the insulating layer is between the first and second electrically conductive layers and wherein the first and second electrically conductive layers and the insulating layer are on a side of the lens facing the controllable anodes and phosphor layers, wherein the second electrically conductive layer is located closer to the first substrate than the first electrically conductive layer and comprises a first plurality of holes corresponding to a second plurality of holes in the insulating layer;

a plurality of opaque field emitter cones mounted to the first electrically conductive layer in the first and second plurality of holes, emitting electrons to selectively bombard the phosphors layers, wherein the plurality of opaque field emitter cones covers less than ten percent of the display area of the second substrate, wherein the emitted electrons travel through a space between the second electrically conductive layer and the phosphor layer, wherein light emitted from the phosphor layer travels back through said space and through the second substrate to be viewed by a viewer of the display.

10. An emissive display according to claim 9, wherein a distance between the second electrically conductive layer and the anode is in a range less than 400 μm.

11. An emissive display according to claim 9, wherein a distance between the second electrically conductive layer and the anode is in a range of 100 μm.

12. An emissive display according to claim 4, wherein one of the first and second transparent electrically conductive layers is patterned in rows and the other is patterned in columns.

* * * * *